US006752307B2

(12) United States Patent
Raymond

(10) Patent No.: US 6,752,307 B2
(45) Date of Patent: Jun. 22, 2004

(54) APPARATUS FOR DISPENSING PLASTIC FASTENERS AND NEEDLE LOCK THEREFOR

(75) Inventor: Jeffrey A. Raymond, Leominster, MA (US)

(73) Assignee: Avery Dennison Corporation, Pasadena, CA (US)

( * ) Notice: Subject to any disclaimer, the term of this patent is extended or adjusted under 35 U.S.C. 154(b) by 81 days.

(21) Appl. No.: 10/209,300

(22) Filed: Jul. 31, 2002

(65) Prior Publication Data

US 2003/0029899 A1 Feb. 13, 2003

Related U.S. Application Data

(63) Continuation-in-part of application No. 09/483,180, filed on Jan. 13, 2000, now Pat. No. 6,267,285, and a continuation-in-part of application No. 09/483,181, filed on Jan. 13, 2000, now Pat. No. 6,418,597.

(60) Provisional application No. 60/122,557, filed on Mar. 2, 1999.

(51) Int. Cl.[7] ..... B25C 1/04

(52) U.S. Cl. ..... 227/67; 112/168; 112/226

(58) Field of Search ..... 227/67, 69, 71; 112/168, 167, 199, 288, 162, 260, 226

(56) References Cited

U.S. PATENT DOCUMENTS

| | | | | |
|---|---|---|---|---|
| 1,067,818 A | * | 7/1913 | Keller | 112/93 |
| 2,495,586 A | * | 1/1950 | Kufall | 112/226 |
| 4,611,740 A | * | 9/1986 | Kunreuther | 227/67 |
| 4,660,718 A | | 4/1987 | Kato et al. | |
| 4,877,172 A | * | 10/1989 | Franklin et al. | 227/69 |
| 4,901,854 A | | 2/1990 | Bone et al. | |
| 4,967,677 A | * | 11/1990 | Seiriki et al. | 112/168 |
| 5,024,365 A | | 6/1991 | Bourque | |
| 5,033,664 A | | 7/1991 | Bone et al. | |
| 5,205,458 A | | 4/1993 | Kunreuther | |
| 5,321,872 A | | 6/1994 | Merser | |
| 5,405,070 A | | 4/1995 | Kunreuther | |
| 5,463,799 A | | 11/1995 | Graham | |
| 5,593,033 A | | 1/1997 | Kunreuther | |
| 5,683,025 A | | 11/1997 | Grendol | |
| 5,772,073 A | | 6/1998 | Deschenes | |
| 5,810,238 A | | 9/1998 | Kunreuther | |
| 5,843,001 A | * | 12/1998 | Goldenberg | 600/567 |
| 5,890,446 A | * | 4/1999 | Koshinaka | 112/168 |
| 6,026,544 A | | 2/2000 | Deschenes et al. | |
| 6,267,285 B1 | | 7/2001 | Raymond et al. | |
| 6,561,406 B1 | * | 5/2003 | Furutsu et al. | 227/67 |

FOREIGN PATENT DOCUMENTS

| | | |
|---|---|---|
| AU | 243745 | 3/1963 |

* cited by examiner

*Primary Examiner*—Scott A. Smith
(74) *Attorney, Agent, or Firm*—Kriegsman & Kriegsman

(57) ABSTRACT

A needle assembly for a tagger gun includes a needle carrier slidably disposed within the tagger gun casing, a needle removably mounted into a needle bore in the needle carrier, and a needle lock snap-mounted into a needle lock bore in the needle carrier. The needle lock includes a locking post having a first end and a second end, and an enlarged head formed onto the second end. The locking post is shaped to include a longitudinally-extending slot which bifurcates the first end into a pair of parallel fingers. A ratchet-shaped tooth is formed onto each finger, each tooth including a tapered surface for guiding the needle lock into needle lock bore and an engagement surface for retaining the needle lock mounted in the needle carrier. In use, the needle lock can be rotated about its longitudinal axis to selectively lock the needle in place within the needle bore.

30 Claims, 14 Drawing Sheets

FIG. 5
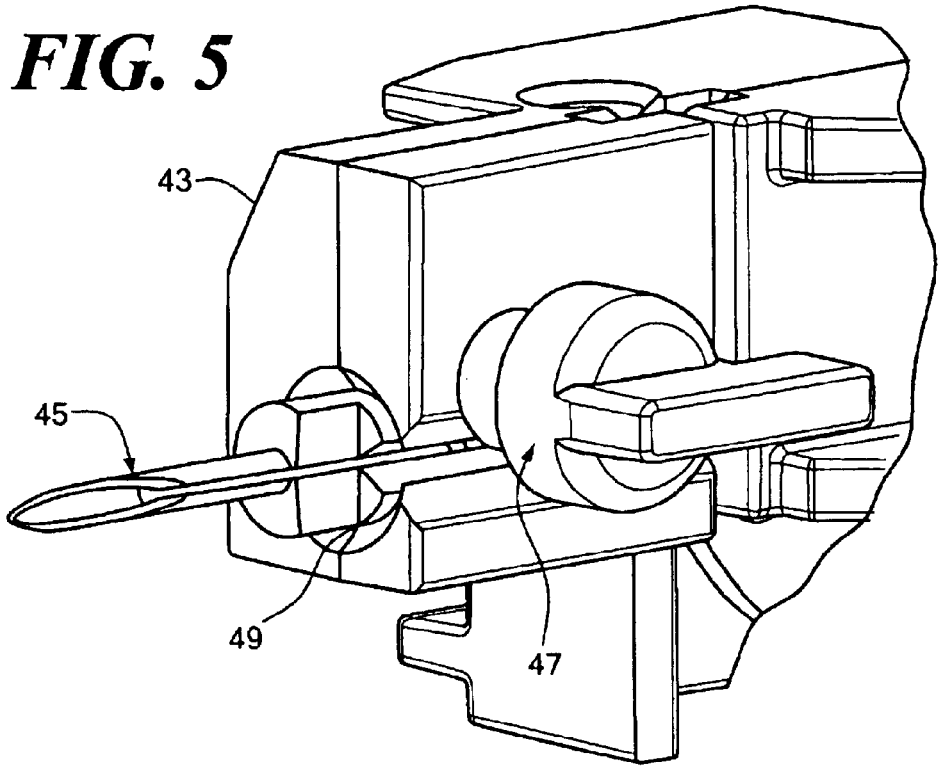
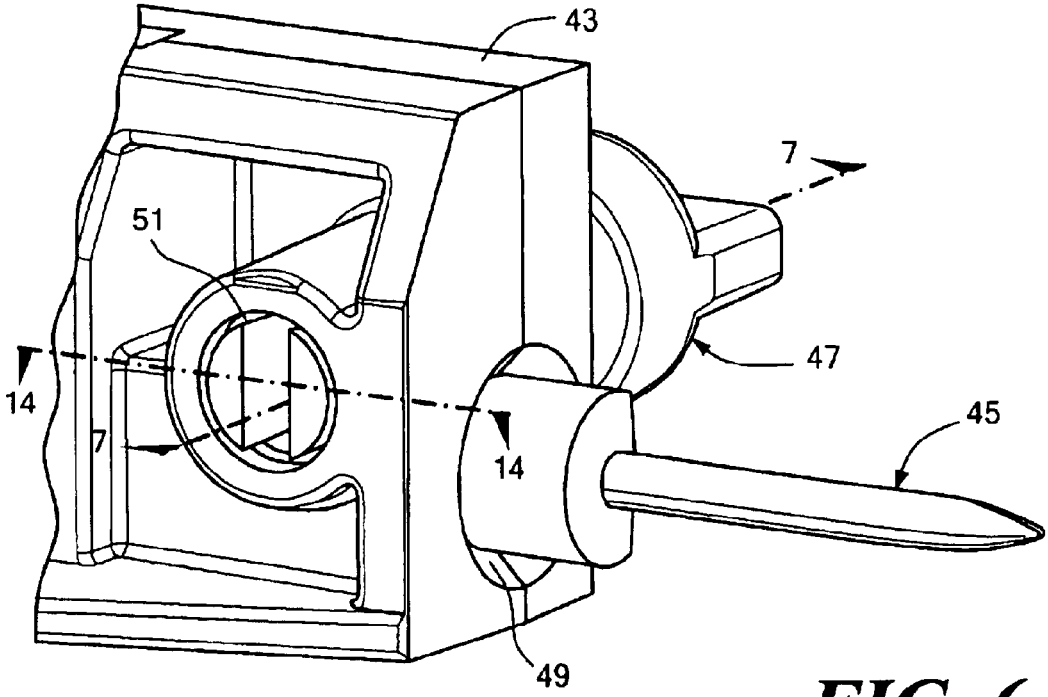
FIG. 6

APPARATUS FOR DISPENSING PLASTIC FASTENERS AND NEEDLE LOCK THEREFOR

CROSS-REFERENCE TO RELATED APPLICATIONS

The present application is a continuation-in-part of U.S. patent application Ser. No. 09/914,757, pending the disclosure of which is incorporated by reference. U.S. patent application Ser. No. 09/914,757, in turn, claims the benefit under 35 U.S.C. §119(e) of U.S. Provisional Patent Application Serial No. 60/122,557, filed Mar. 2, 1999, the disclosure of which is incorporated herein by reference. In addition, U.S. patent application Ser. No. 09/914,757 is a continuation-in-part of U.S. patent application Ser. No. 09/483,180, filed Jan. 13, 2000, now U.S. Pat. No. 6,267,285, the disclosure of which is incorporated herein by reference, and is a continuation-in-part of U.S. patent application Ser. No. 09/483,181, filed Jan. 13, 2000, now U.S. Pat. No. 6,418,597, the disclosure of which is incorporated herein by reference.

BACKGROUND OF THE INVENTION

The present invention relates generally to an apparatus for dispensing individual plastic fasteners from fastener stock and, more particularly, to a needle lock for an apparatus for dispensing individual plastic fasteners from fastener stock.

Plastic fasteners of the type having a cross-bar at one end, a paddle at the other end and a thin filament or cross-link connecting the two ends are well known in the art and are widely used in commerce to attach labels, price tags or other items to articles in a manner which minimizes the risk of inadvertent detachment therefrom. Typically, such plastic fasteners are manufactured in the form of a supply of fastener stock, the fastener stock being produced by molding or stamping from flexible plastic materials, such as nylon, polyethylene, and polypropylene.

In one well known type of fastener stock, the cross bar end of each fastener is connected to a runner bar to form a clip of fasteners. In another known type of fastener stock, often referred to simply as ladder stock, a pair of elongated side members are interconnected by a plurality of cross links or filaments. One of the side members is shaped to define a plurality of cross bars which are joined together by short severable connectors, the connectors being defined by indentations or notches formed along the side member. The other side member is shaped to define either a plurality of paddles or cross bars which are similarly joined together by short severable connectors.

The dispensing of individual fasteners from fastener stock is often accomplished with an apparatus commonly referred to as a tagger gun. A tagger gun is a hand held trigger operated device which is constructed to accept fastener stock and dispense individual fasteners into one or more desired articles (i.e., items to be tagged).

A tagger gun commonly includes a gun-shaped housing and a needle which is slidably disposed within a cylindrical needle receiving bore formed in the front of the housing, the needle including a sharpened tip. Tagger guns also typically include an indexing mechanism for feeding the cross bar end of an individual fastener into the rear end of the hollow needle and an ejection mechanism for pushing the cross bar end of the individual fastener that has been fed into the hollow needle out through its sharpened tip.

In use, an operator can use a tagger gun of the type described above to attach an individual plastic fastener to one or more desired objects in the following manner. Specifically, the operator first loads the supply of fastener stock into the tagger gun. With the fastener stock loaded, the operator inserts the sharpened tip of the needle through the items to be tagged. The operator then activates the trigger of the tagger gun which, in turn, first feeds the cross bar end of an individual fastener into alignment with the rear end of the hollow needle and then urges the cross bar end of the individual fastener out through the sharpened tip of the hollow needle. Once the cross bar end of the individual fastener exits the sharpened tip of the hollow needle, the cross bar end and the paddle of the individual fastener are disposed on opposite sides of the tagged items, thereby completing the tagging process. Withdrawing the tagger gun away from the dispensed fastener causes the dispensed fastener to separate from the remainder of the fastener stock loaded into the tagger gun. The process can be repeated as deemed necessary by the operator. It should be noted that feeding and ejection mechanisms of some tagger guns are manually operated while the feeding and ejection mechanisms of some other tagger guns are powered by an electric motor or a pneumatic device.

Tagger guns have been developed and are in use with both of the above described types of fastener stock.

For example, in U.S. Pat. No. 4,456,123 to D. B. Russell, which is incorporated herein by reference, there is disclosed an apparatus for dispensing fasteners which is manufactured and sold by AVERY DENNISON CORPORATION® of Pasadena, Calif. as the SYSTEM 1000® SWIFTACHER® Tool. The apparatus can be used to store, feed and dispense fastener stock of the type which includes a plurality of connected fasteners, each fastener comprising a flexible filament and a transversely disposed end-bar at one end, end-bars of adjacent fasteners being joined end-to-end by severable connectors at a portion of their peripheries. The apparatus comprises a hollow casing and a dispensing needle mounted to the casing, the needle having a longitudinal bore for slidably receiving the end-bar and a slot communicating with the longitudinal bore slidably receiving the filament. The apparatus also comprises means for advancing a fastener from a first position remote from the needle bore to a second position adjacent the rear end of the bore with the end-bar transversely disposed to the longitudinal axis of the bore, means for aligning the end-bar with the bore and means for dispensing the end-bar through the bore.

Other types of tagger guns are disclosed in U.S. Pat. Nos. 5,772,073, 5,683,025, 5,024,365, 4,533,076, 4,456,161, 4,121,487, and 4,456,123.

Tagger guns of the type described above typically include a conventional needle which comprises a stem portion and a base portion. The stem portion, which may be made from stamped and rolled metal, is a generally cylindrical member terminating at one end in a sharp tip designed for insertion through a garment or like object. The stem portion also has a slotted bore which extends substantially longitudinally therethrough. The base portion may be made of a plastic that has been insert-molded onto that end of the stem portion that is distal to the tip. (Alternatively, the stem portion and the base portion may be a unitary structure made of metal or another suitable material.) The base portion is provided with a slotted longitudinal bore that is aligned with the bore of the stem portion and is also provided with a scalloped-shaped recess on its outer surface. The bores of the stem portion and the base portion of the needle are appropriately dimensioned so that the cross-bar of a fastener may be inserted thereinto from the rear of the base portion, traverse the length of the needle through the bore of the stem portion and then exit the needle through the sharpened tip. The slots of the stem portion and the base portion are appropriately dimensioned to permit the filament of the fastener to extend therethrough while its associated cross-bar is disposed within the needle.

It should be noted that, during the life of a tagger gun, the needle may require replacement. For example, the needle of a tagger gun may break, thereby precluding further use, which is highly undesirable. As another example, the sharpened tip of a needle may become dulled after considerable use which, in turn, can cause the needle to potentially rip or tear future items to be tagged, which is highly undesirable.

Accordingly, tagger guns are often constructed to allow for its needle to be removed and replaced, as deemed necessary. Specifically, tagger guns are commonly constructed so that the needle may be slidably disposed within a tagger gun housing. The needle, in turn, can then be fixedly secured (i.e., locked in place) within the tagger gun housing using a needle lock.

Needle locks (also commonly referred to as locking pins) are well known and widely used in the art to releasably lock a hollow needle in place within a tagger gun housing. A needle lock is typically slidably disposed within a needle lock bore formed into a side of the tagger gun housing, the longitudinal axis of the needle lock extending at approximately a right angle relative to the longitudinal axis of the hollow needle.

A needle lock typically comprises an elongated, generally cylindrical locking post having a first end and a second end. A scallop-shaped recess is formed on the outer surface of the locking post at about its midpoint. An enlarged button-shaped head is formed onto the first end of the locking post. The head is preferably constructed to facilitate rotation of the needle lock by the user. As an example, a slot may be formed onto the free end of the head which enables the user rotate the needle lock using a screwdriver or other similar instrument. As another example, an elongated handle may be formed onto the free end of the head which enables the user to rotate the needle lock with his/her fingers.

A needle lock of the type described above is typically disposed within the housing of a tagger gun in the following manner. The second end of the needle lock is inserted into a needle lock bore formed into the housing of the tagger gun. The needle lock is inwardly advanced into the needle lock bore until the enlarged, button-shaped head of the needle lock abuts against the tagger gun housing, thereby precluding further inward displacement.

It should be noted that the scalloped-shaped recess formed on the needle lock is appropriately dimensioned to receive the base portion of the hollow needle, and the scalloped-shaped recess formed on the base portion of the hollow needle is appropriately dimensioned to receive the needle lock. As such, the needle lock can be rotated between a first position in which the needle lock secures the needle in place within the tagger gun housing (said position being referred to herein simply as the locked position) and a second position in which the needle lock allows the needle to freely slide in and out of the needle receiving bore in the tagger gun housing (said position being referred to herein simply as the unlocked position). Specifically, with the needle lock disposed in its locked position, the locking post of the needle lock aligns within the scalloped-shaped recess formed in the needle which, in turn, causes the needle lock to lockably engage the base portion of the needle and preclude longitudinal displacement. To the contrary, with the needle lock disposed in its unlocked position, the locking post of the needle lock is rotated out from the scalloped-shaped recess in the needle which, in turn, causes the needle lock to disengage from the base portion of the needle, thereby enabling the needle to be axially displaced within the needle receiving bore formed in the tagger gun housing.

Although well-known and widely used in commerce, locking pins of the type described above suffer from a notable drawback. Specifically, locking pins of the type described above are not permanently retained within the tagger gun housing. Rather, locking pins of the type described above are removably mounted into the tagger gun housing. As such, it has been found that conventional needle locks are often inadvertently removed from the housing and subsequently lost. As can be appreciated, without the needle lock, there is no means for fixedly securing the needle within the housing of the tagger gun, thereby rendering the tagger gun incapable of being used, which is highly undesirable.

SUMMARY OF THE INVENTION

It is an object of the present invention to provide a new and improved apparatus for dispensing individual plastic fasteners from fastener stock.

It is another object of the present invention to provide an apparatus of the type described above which includes a gun-shaped housing and a hollow, slotted needle which is removably mounted within a cylindrical needle receiving bore.

It is yet another object of the present invention to provide an apparatus of the type described above which includes a needle lock for selectively locking said needle in place within the needle receiving bore.

It is still another object of the present invention to provide an apparatus of the type described above in which the needle lock is permanently mounted into a needle lock receiving bore.

It is another object of the present invention to provide an apparatus of the type described above which has a limited number of parts, which is easy to use, and which is inexpensive to manufacture.

Accordingly, as one feature of the present invention, there is provided an apparatus for dispensing plastic fasteners, each plastic fastener comprising a cross-bar end, said apparatus comprising a casing, a needle assembly disposed at least partially within said casing, said needle assembly comprising, a needle carrier slidably disposed at least partially within said casing, said needle carrier being shaped to include a needle receiving bore and a needle lock receiving bore, a needle removably disposed into the needle receiving bore in said needle carrier, and a needle lock for selectively locking said needle within the needle receiving bore, said needle lock being snap-mounted into the needle lock receiving bore in said needle carrier, said needle lock being adapted to engage said needle carrier upon the application of a withdrawal force on said needle lock from said needle carrier, and a mechanism for pushing the cross bar end of a plastic fastener through said needle.

As another feature of the present invention, there is provided a needle assembly for an apparatus for dispensing plastic fasteners, said needle assembly comprising a needle carrier shaped to include a needle receiving bore and a needle lock receiving bore, a needle removably disposed into the needle receiving bore in said needle carrier, and a needle lock for selectively locking said needle within the needle receiving bore of said needle carrier, said needle lock being snap-mounted into the needle lock receiving bore in said needle carrier, said needle lock being adapted to engage said needle carrier upon the application of a withdrawal force on said needle lock from said needle carrier.

As another feature of the present invention, there is provided a needle lock for selectively locking a needle within a needle receiving bore, said needle lock comprising a locking post having a first end and a second end, the first end of said locking post being shaped to include a slot, and an enlarged head formed onto the second end of said locking post.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 5 is an enlarged, fragmentary, right side perspective view of the needle assembly shown in FIG. 2;

FIG. 6 is an enlarged, fragmentary, left side perspective view of the needle assembly shown in FIG. 2;

DETAILED DESCRIPTION OF THE PREFERRED EMBODIMENT

Figure 1:
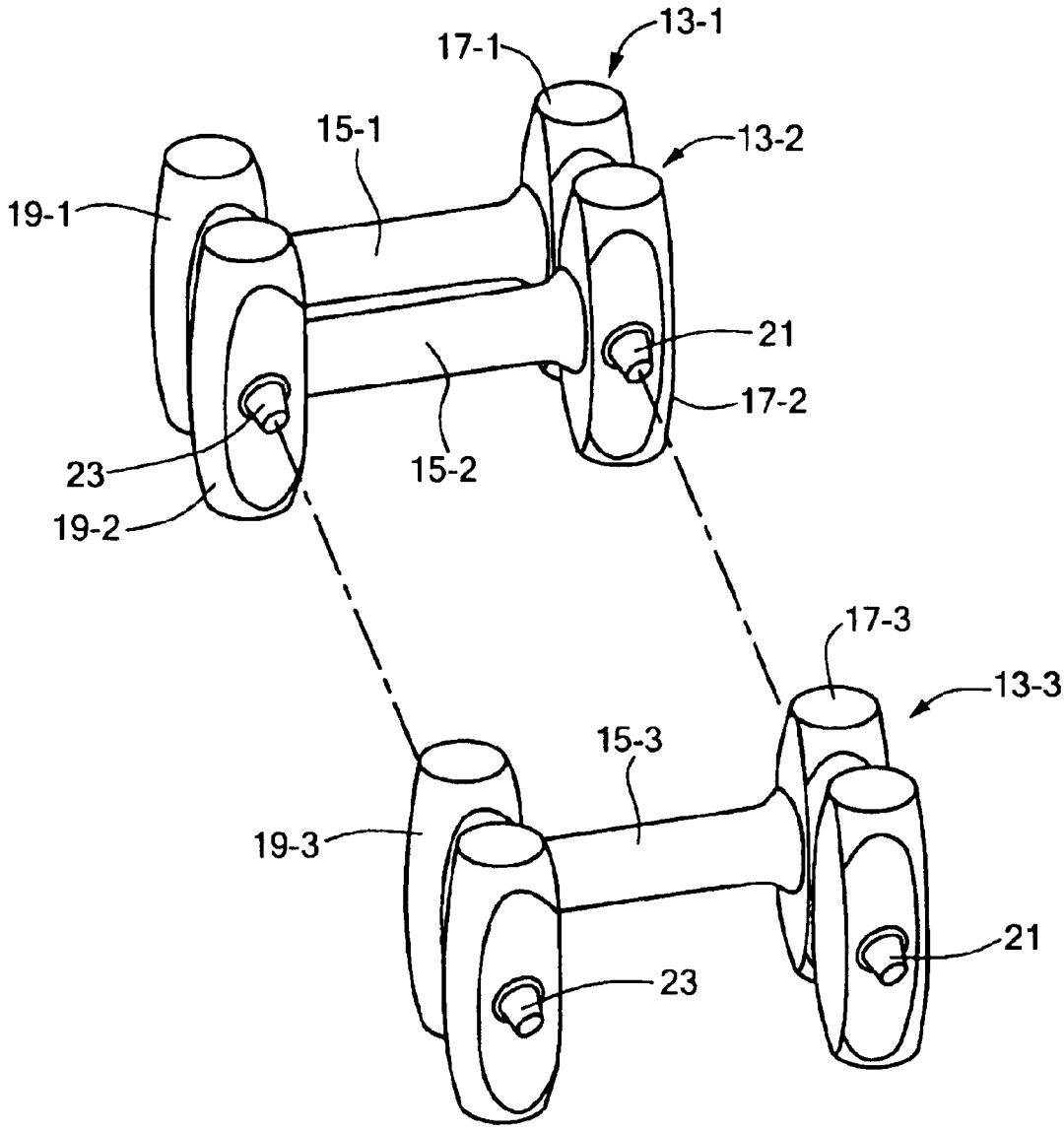
FIG. 1 is a partially-exploded perspective view of a fastener clip constructed in accordance with the teachings of the present invention.

Referring now to FIG. 1, there is shown a fastener clip which is represented generally by reference numeral 11. Fastener clip 11 is of the type disclosed in U.S. Pat. No. 6,267,285 to J. Raymond et al., which is incorporated herein by reference. Fastener clip 11, which is a unitary structure preferably made by molding, comprises a plurality of fasteners 13-1 through 13-3, fasteners 13 being arranged in a parallel, side-by-side, spaced orientation.

Each fastener 13 is preferably made of polyurethane and is well-suited for maintaining a dress shirt in a folded condition. Fastener 13, which is a unitary structure preferably made by molding, comprises a flexible filament 15. Fastener 13 also comprises a first cross-bar 17 and a second cross-bar 19, cross-bar 17 being disposed at a first end of filament 15, cross-bar 19 being disposed at a second end of filament 15, cross-bars 17 and 19 being parallel to one another.

Clip 11 also includes a first plurality of severable connector posts 21 and a second plurality of severable connector posts 23, connector posts 21 connecting the mutually-opposing sides of adjacent cross-bars 17 at their approximate midpoints and extending in a substantially perpendicular direction relative to the longitudinal axes of cross-bars 17, connector posts 23 connecting the mutually-opposing sides of adjacent cross-bars 19 at their approximate midpoints and extending in a substantially perpendicular direction relative to the longitudinal axes of cross-bars 19.

Figure 2:
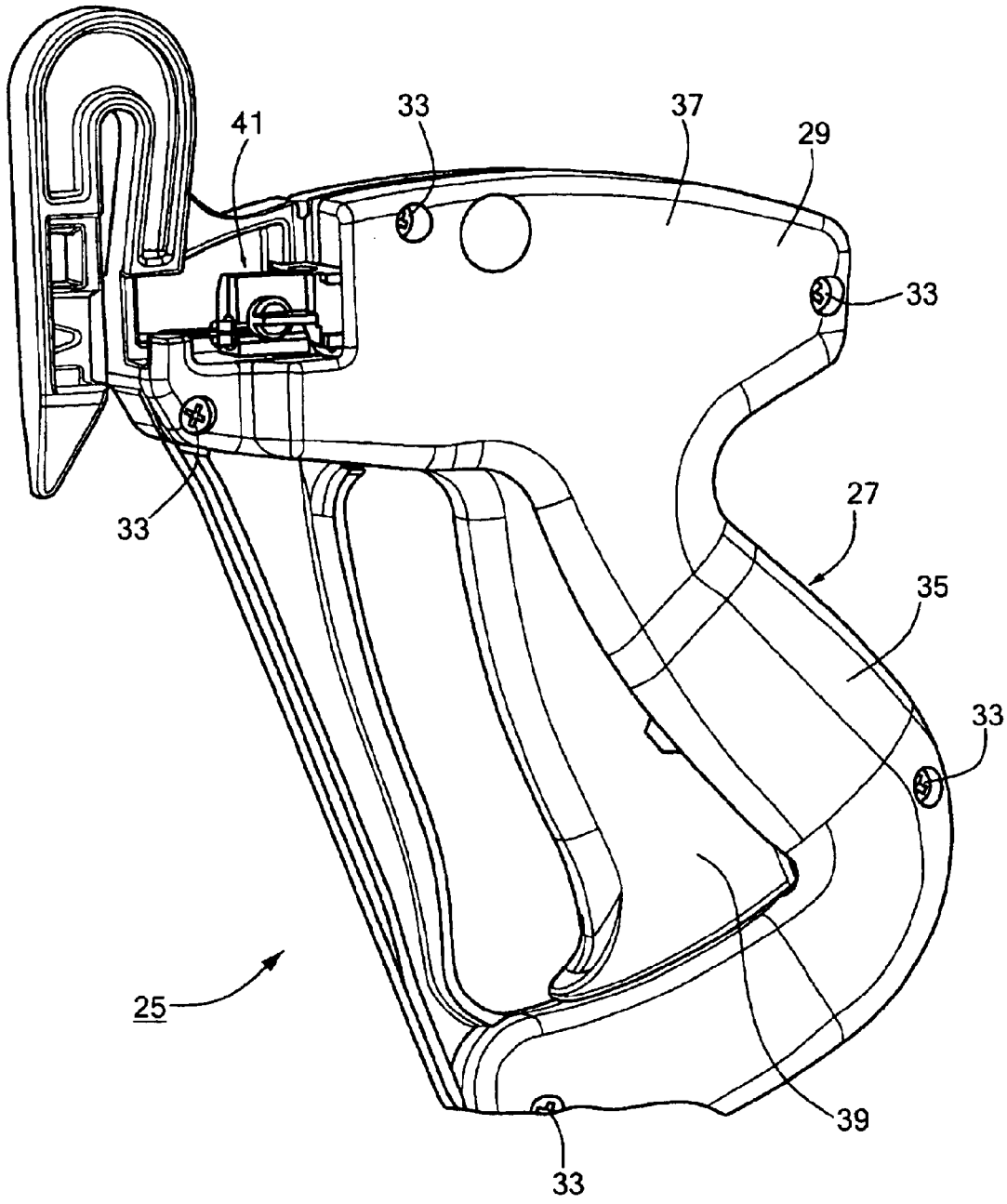
FIG. 2 is a right side, fragmentary, perspective view of an apparatus constructed according to the teachings of the present invention for dispensing individual plastic fasteners from a supply of fastener stock.
Figure 3:
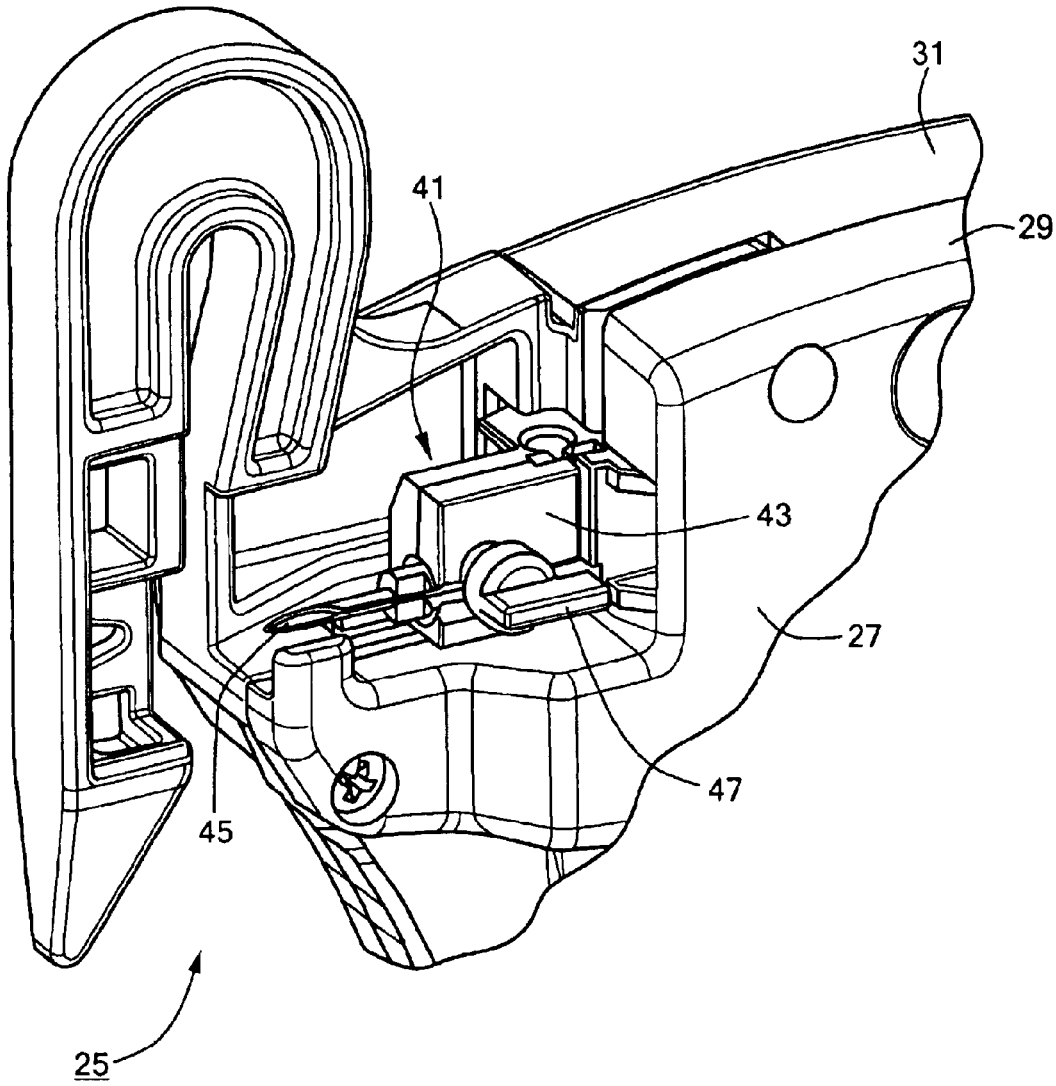
FIG. 3 is an enlarged, right side, fragmentary, perspective view of the apparatus shown in FIG. 2.
Figure 4:
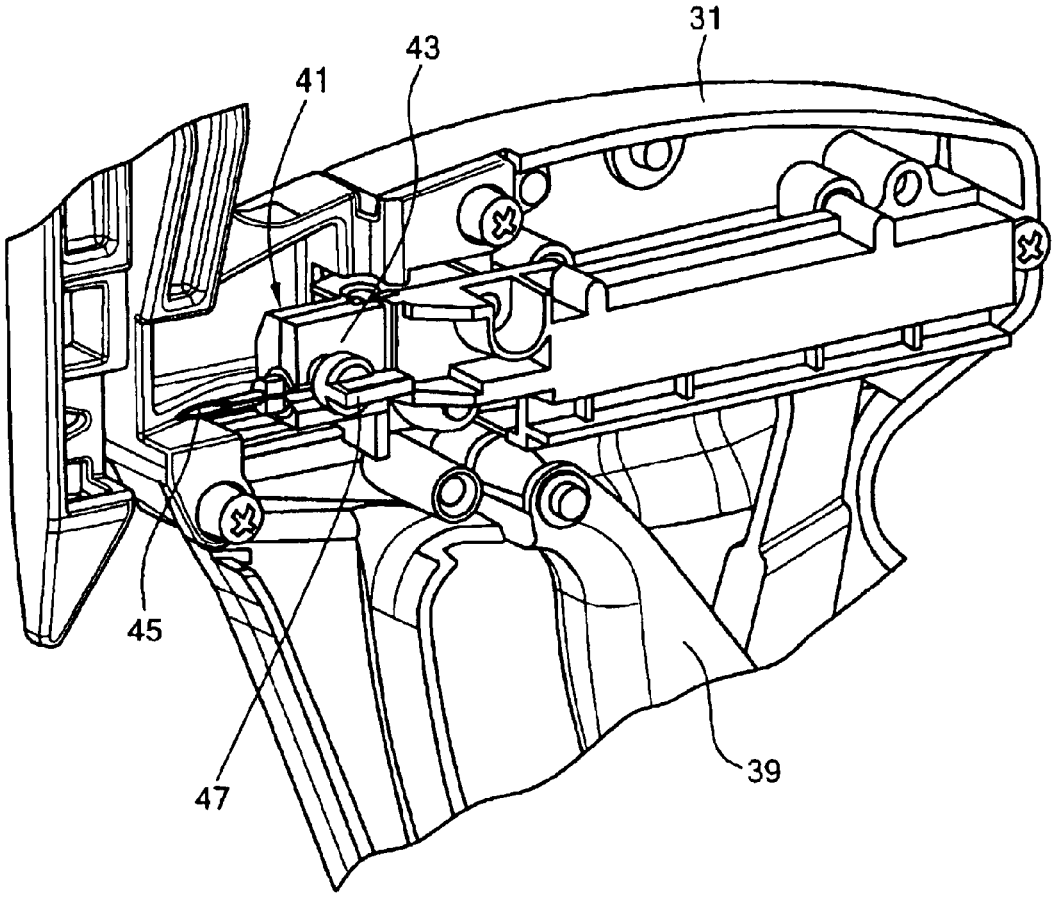
FIG. 4 is an enlarged, right side, fragmentary, perspective view of the apparatus shown in FIG. 2, the apparatus being shown with the right half of its casing removed therefrom.

Referring now to FIGS. 2–4, there is shown an apparatus constructed according to the teachings of the present invention for dispensing individual plastic fasteners 13 from fastener clip 11, the apparatus being identified generally by reference numeral 25. It should be noted that apparatus 25 is designed principally for use in dispensing fasteners 13. However, it is to be understood that apparatus is not limited to dispensing fasteners 13. Rather, it is to be understood that apparatus 25 can be used to dispense any type of conventional plastic fastener which includes at least one crossbar of similar size and shape as cross-bar 17 without departing from the spirit of the present invention.

Apparatus 25 comprises a hollow, gun-shaped casing 27, casing 27 comprising a right half 29 and a left half 31. Halves 29 and 31, which may be fabricated from any convenient durable material, such as molded plastic, are joined together by a plurality of screws 33 and jointly define a handle portion 35 and a barrel portion 37. It should be noted that the particular construction of casing 27 does not serve as a principal feature of the present invention. Accordingly, casing 27 could be replaced with other types of tagger gun casings which are well known in the art without departing from the spirit of the present invention. For example, casing 27 could be replaced with the casing disclosed in U.S. Pat. No. 6,267,285 to J. Raymond et al. without departing from the spirit of the present invention.

Apparatus 11 also includes a triggering mechanism for activating the process of dispensing individual plastic fasteners 13 from fastener clip 11, the triggering mechanism including a trigger 39. It should be noted that the particular construction of the triggering mechanism does not serve as a principal feature of the present invention and therefore, is not described in detail herein. However, it is to be understood that triggering mechanism represents any tagger gun triggering mechanism which is well known in the art. For example, the triggering mechanism for apparatus 25 may be of the type disclosed in U.S. Pat. No. 6,267,285 to J. Raymond et al.

Apparatus 11 further includes a needle assembly 41. As can be seen in FIGS. 3 and 4, needle assembly 41 comprises a needle carrier 43 which is slidably disposed within casing 27, a needle 45 which is slidably mounted in needle carrier 43, and a needle lock 47 which is mounted in needle carrier 43 and which servers to lockably retain needle 45 within needle carrier 43, as will be described further in detail below. It should be noted that the construction of needle assembly 41 and, more particularly, the construction of needle lock 47 serves as the principal novel feature of the present invention.

Needle carrier 43, which is preferably constructed of molded plastic or another suitable material, is slidably mounted in slots formed into the inner surfaces of right half 29 and left half 31 of casing 27 and is normally biased rearwardly in barrel portion 37 by a spring. As seen most clearly in FIGS. 5–7, a needle receiving bore 49 extends longitudinally in from the front end of needle carrier 43, needle receiving bore 49 being generally circular in lateral cross-section. Furthermore, a needle lock receiving bore 51 extends laterally across the front end of needle carrier 43, needle lock receiving bore 51 being disposed directly above and extending orthogonally in relation to needle receiving bore 49, for reasons to become apparent below. As seen most clearly in FIG. 7, needle lock receiving bore 51 is generally circular in lateral cross-section and includes an entry end 53 formed in one side of needle carrier 43 and an exit end 55 formed in the other side of needle carrier 43. Needle carrier 43 is countersunk at exit end 55 so as to form an annularly-shaped shelf 57 around bore 51, shelf 57 being spaced slightly in from the outer surface of needle carrier 43. As will be described further below, shelf 57 helps to retain needle lock 47 within needle lock receiving bore 51, which is a principal object of the present invention. However, it is to be understood that needle carrier 43 need not be countersunk at exit end 55 for needle lock 47 to be adequately retained within needle lock receiving bore 51. Rather, it is to be understood that needle carrier 43 could be flat at exit end 55 without departing from the spirit of the present invention.

It should be noted that apparatus 11 is not limited to the particular construction of needle carrier 43 as described herein. Rather, it is to be understood that needle carrier 43 could be replaced with any well-known needle carrier which is shaped to include a needle receiving bore and a needle lock receiving bore without departing from the spirit of the present invention. For example, needle carrier 43 may be of the type disclosed in U.S. Pat. No. 6,267,285 to J. Raymond et al. without departing from the spirit of the present invention.

Figure 8:
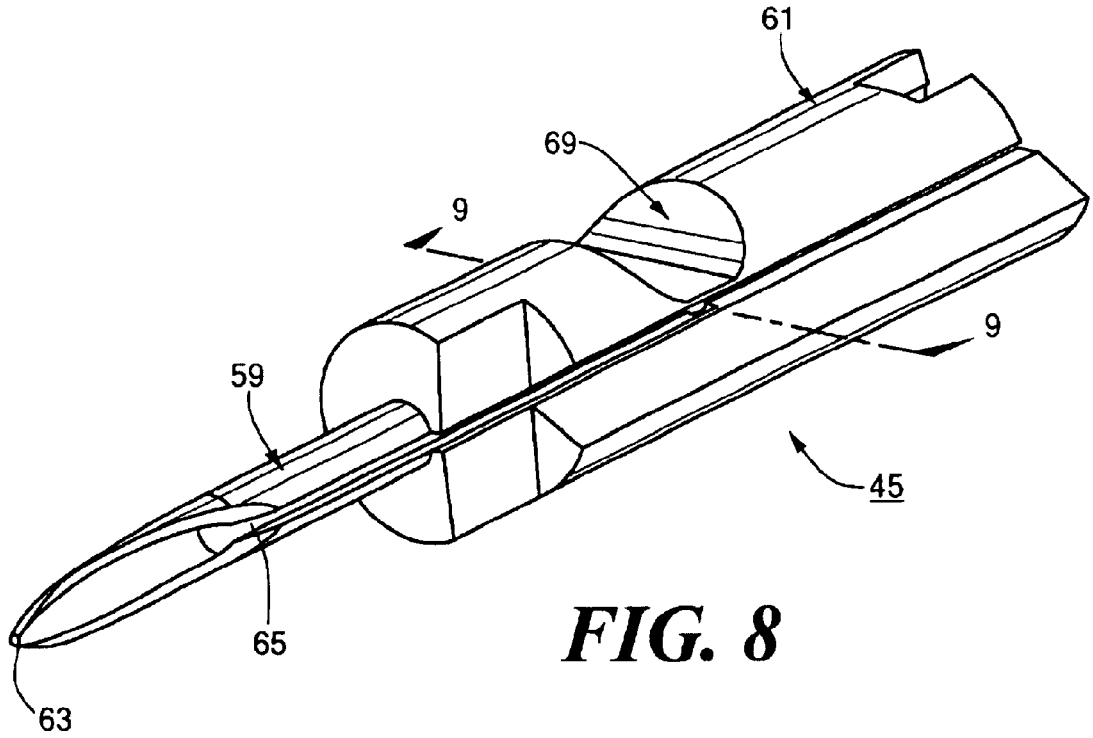
FIG. 8 is an enlarged, perspective view of the needle shown in FIG. 2.
Figure 9:
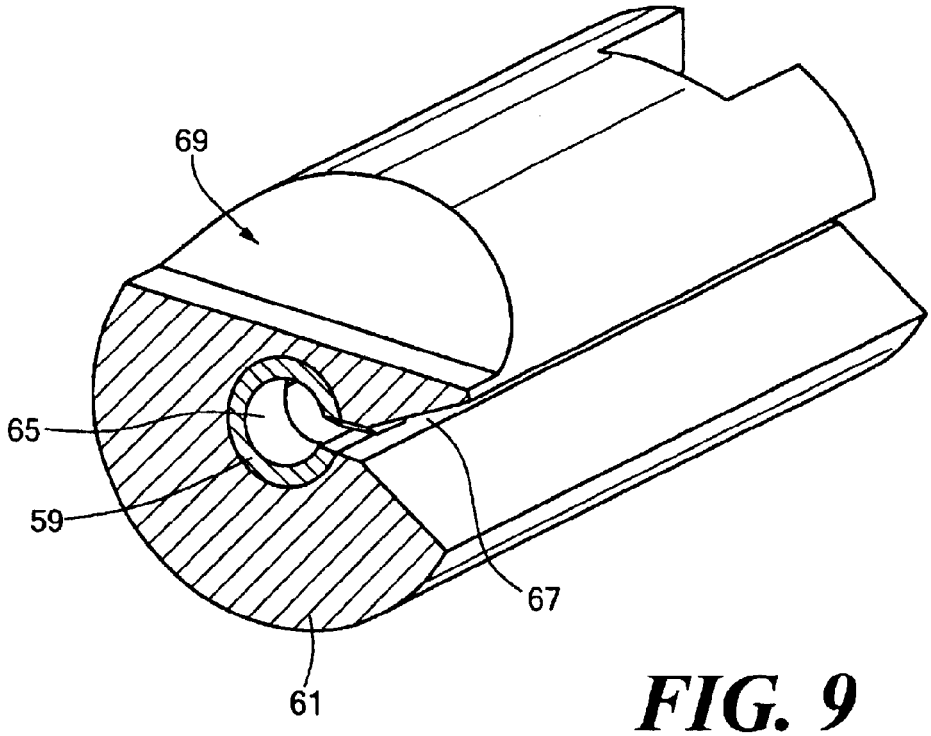
FIG. 9 is a perspective, section view of the needle shown in FIG. 8, taken along lines 9—9.
Figure 10:
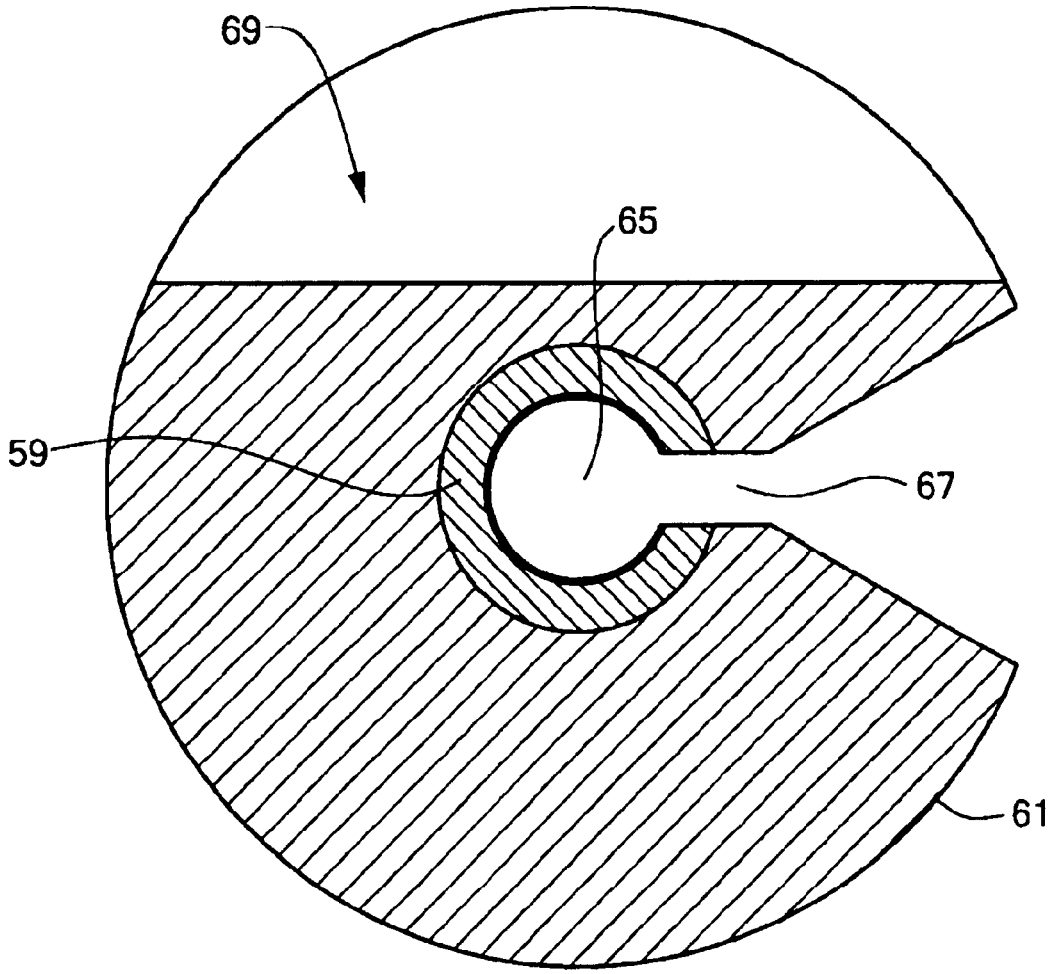
FIG. 10 is a plan, section view of the needle shown in FIG. 8, taken along lines 9—9.

Referring now to FIGS. 8–10, needle 45 comprises a stem portion 59 and a base portion 61. Stem portion 59, which may be made from stamped and rolled metal, is a generally cylindrical member terminating at one end in a sharpened tip 63 which is designed for insertion through a garment or like object. Stem portion 59 also has a slotted bore 65 extending longitudinally therethrough. Base portion 61 may be made of a plastic that has been insert-molded onto that end of stem portion 59 that is distal to tip 63. (Alternatively, stem portion 59 and base portion 61 may be a unitary structure made of metal or another suitable material.) Base portion 61 is provided with a slotted longitudinal bore 67 that is aligned with bore 65 of stem portion 59. Base portion 61 is also provided with a scalloped-shaped recess 69 on its outer surface whose purpose will be described below. The bores of stem portion 59 and base portion 61 are appropriately dimensioned so that cross-bar 17 of a fastener 13 may be inserted thereinto from the rear of base portion 61, traverse the length of needle 45 through bore 65 of stem portion 59 and then exit needle 45 through sharpened tip 63. The slots of stem portion 59 and base portion 61 are appropriately dimensioned to permit filament 15 of fastener 13 to extend therethrough while its associated cross-bar 17 remains disposed within needle 45, said slots being orientated in apparatus 25 so as to face towards right half 29 of casing 27.

It should be noted that the particular construction of needle 45 does not serve as a principal feature of the present invention. Rather, it is to be understood that needle 45 represents any conventional tagger gun needle which includes a scalloped-shaped recess. For example, needle 45 may be of the type disclosed in U.S. Pat. No. 6,267,285 to J. Raymond et al.

Base portion 61 of needle 45 is sized and shaped to fit snugly within needle receiving bore 49. However, base portion 61 of needle is also sized and shaped to slide longitudinally within needle receiving bore 49, thereby enabling needle 45 to be either mounted into or removed from needle carrier 43, as desired. In this capacity, needle 45 may be removed and replaced with similar needles 45, as deemed necessary by the operator. As such, if needle 45 becomes dulled or broken during use, the operator can replace needle 45 with a new needle, thereby extending the life of apparatus 25, which is highly desirable.

However, in order to properly dispense a fastener 13 into a desired object, needle 45 must first be fixedly secured in place within bore 49 of needle carrier 43 during the dispensing process. Accordingly, the function of needle lock 47 is to releasably secure, or lock, needle 45 in place within bore 49 of needle carrier 43, as will be described further in detail below.

Figure 11:
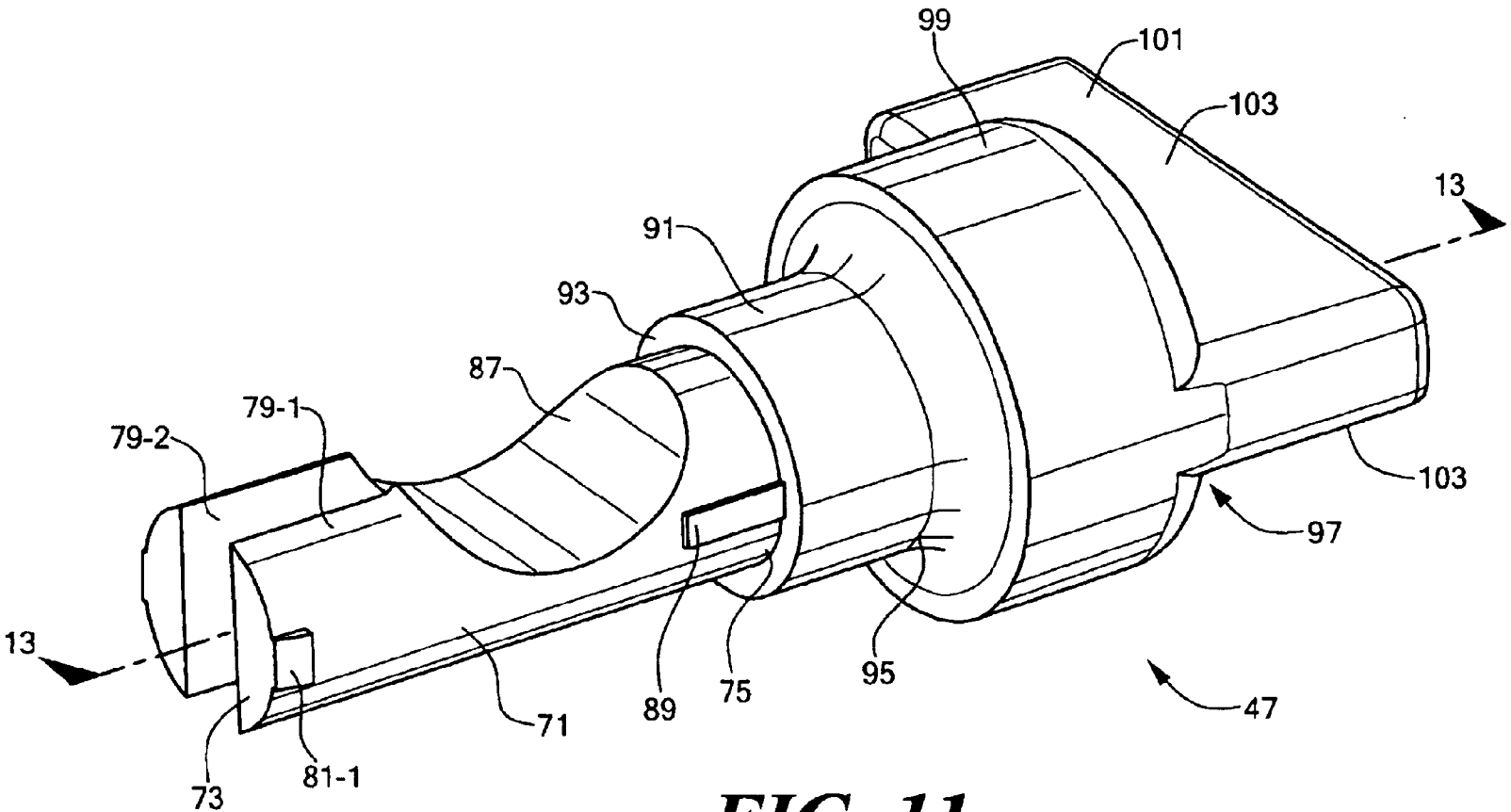
FIG. 11 is an enlarged, front perspective view of the needle lock shown in FIG. 2.
Figure 12:
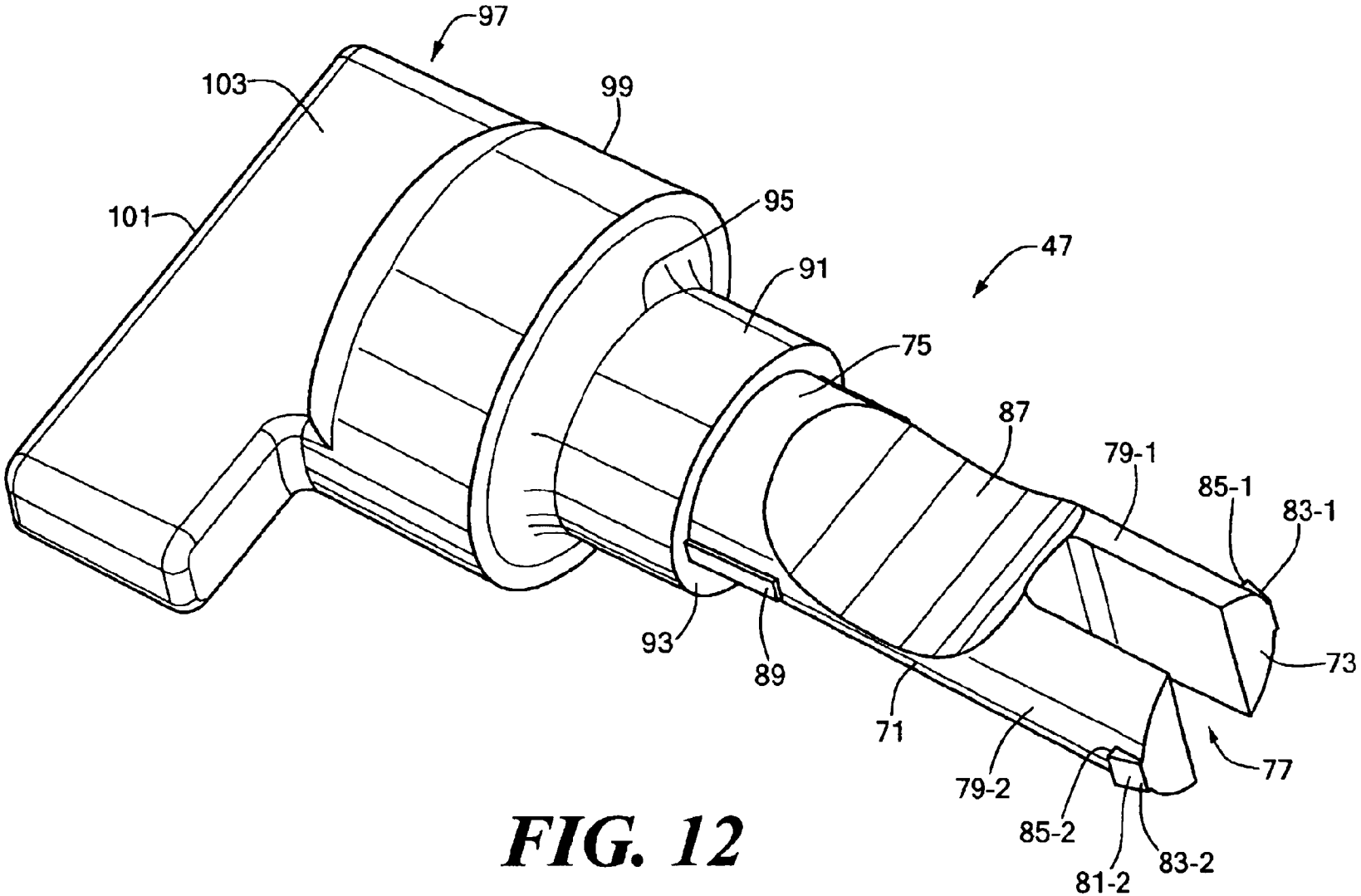
FIG. 12 is an enlarged, top perspective view of the needle lock shown in FIG. 2.
Figure 13:
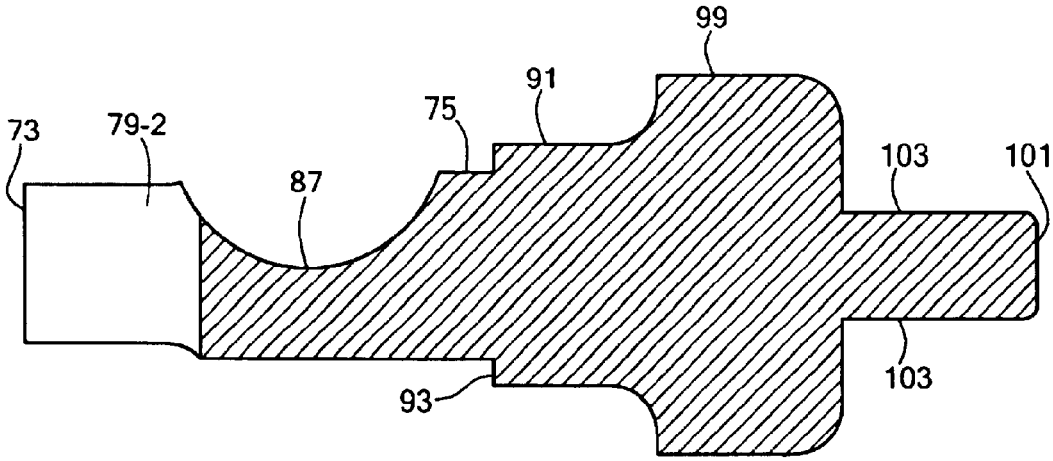
FIG. 13 is a plan, section view of the needle lock shown in FIG. 11, taken along lines 13—13.

As seen most clearly in FIGS. 11–13, needle lock (or locking pin) 47 is an integral piece which is preferably constructed of molded plastic or another suitable material. Needle lock 47 comprises an elongated, generally cylindrical locking post 71 having a first end 73 and a second end 75.

First end 73 of locking post 71 is shaped to include a longitudinally-extending slot 77 which bifurcates first end 73 into first and second fingers 79-1 and 79-2. First and second fingers 79-1 and 79-2 extend longitudinally in a spaced apart, parallel relationship. As will be described further in detail below, slot 77 enables fingers 79 to be inwardly pivoted upon the application of a compression force, thereby reducing the width of locking post 71 at first end 73. Upon the withdrawal of said compression force, fingers 79 resiliently outwardly pivot back to return to their original, parallel configuration.

A first ratchet-shaped tooth 81-1 is formed onto the outer surface of finger 79-1 at first end 73. Tooth 81-1 is shaped to include a tapered surface 83-1 which extends outwardly and rearwardly from the outer surface of finger 79-1 at first end 73 at an acute angle in relation to the longitudinal axis of locking post 71. Tooth 81-1 is also shaped to include an engagement surface 85-1 which extends outwardly from the outer surface of finger 79-1 at an approximate right angle in relation to the longitudinal axis of locking post 71. Similarly, a second ratchet-shaped tooth 81-2 is formed onto the outer surface of finger 79-2 at first end 73. Tooth 81-2 is shaped to include a tapered surface 83-2 which extends outwardly and rearwardly from the outer surface of finger 79-2 at first end 73 at an acute angle in relation to the longitudinal axis of locking post 71. Tooth 81-2 is also shaped to include an engagement surface 85-2 which extends outwardly from the outer surface of finger 79-2 at an approximate right angle in relation to the longitudinal axis of locking post 71.

It should be noted that teeth 81 are shown as extending along a relatively small portion of the outer surface of fingers 79. However, it is to be understood that teeth 81 could be modified to extend along a greater length of the outer surface of fingers 79 without departing from the spirit of the present invention.

A scallop-shaped recess 87 is formed onto the outer surface of locking post 71 between first end 73 and second end 75. Scalloped-shaped recess 87 is appropriately dimensioned to receive base portion 61 of hollow needle 45, as will be described further in detail below.

A pair of thin tabs 89 are formed onto the outer surface of locking post 71 at second end 75. Tabs 89 extend longitudinally along a portion of the length of locking post 71 and are spaced approximately 180 degrees apart. As will be described further below, when needle lock 47 is mounted into needle carrier 43, tabs 89 serve to create a secure, press-fit of second end 75 within entry end 53 of needle lock receiving bore 51.

An enlarged, button-shaped head 91 is formed onto first end 75 of locking post 71, head 91 and locking post 71 sharing a common longitudinal axis. Head 91 is generally circular in lateral cross-section and includes a substantially flat, annular abutment surface 93 around second end 75 of locking post 71 and a substantially flat outer surface 95. It should be noted that head 91 has a diameter which is greater than the diameter of locking post 71 at second end 75. As such, head 91 can be used as a stop for limiting the insertion of needle lock 47 into needle carrier 43.

It should be noted that head 91 of needle lock 47 is not limited to having a button shape. Rather, it is to be understood that head 91 of needle lock 47 could be alternatively configured without departing from the spirit of the present invention. Specifically, head 91 of needle lock 47 could be configured into any shape so long as the length and/or width of head 91 is greater than the length and/or width of locking post 71 at second end 75.

An enlarged handle 97 is formed onto outer surface 95 of locking post 71 to facilitate the manual rotation of needle lock 47 about its longitudinal axis. Handle 97 comprises an enlarged cylindrically-shaped knob 99 which is formed onto outer surface 95 of head 91 and an elongated, rectangular pivot arm 101 which is formed onto the free end of knob 99. Pivot arm 101 includes a pair of elongated, flat gripping surfaces 103 onto which the thumb and forefinger of an operator grasp when manually rotating needle lock 47.

It should be noted that needle lock 47 is not limited to including handle 101 to facilitate rotation. Rather, it is to be understood that needle lock 47 could be alternatively constructed to facilitate rotation without departing from the spirit of the present invention. For example, rather than using handle 101, a slot may be formed into outer surface 95 of head 91, said slot enabling the user to rotate the needle lock using a screwdriver or other similar instrument.

As noted briefly above, needle lock 47 is adapted to be slidably mounted into needle lock receiving bore 51 of needle carrier 43. With needle lock 47 securely disposed within bore 51, needle lock 47 is sized and shaped to be freely rotated about its longitudinal axis. Specifically, needle lock 47 is capable of rotation between a locked position in which needle lock 47 engages needle 45 so as to preclude removal of needle 45 from needle carrier 43 and an unlocked position in which needle lock 47 disengages from needle 45 so as to allow needle 45 to be slidably removed from needle carrier 43, as will be described further in detail below.

Needle lock 47 is adapted to be snap-fit into bore 51. As will be described further below, when snap-fit into bore 51, needle lock 47 engages needle carrier 43 in such a manner so as to permanently secure needle lock 47 in its mounted position in needle carrier 43, which is a principal object of the present invention. It should be noted that by permanently mounting needle lock 47 within needle carrier 43, the operator is precluded from inadvertently losing, damaging or misplacing needle lock 47.

Needle lock 47 can be snap-fit into needle lock receiving bore 51 of needle carrier 43 in the following manner. Specifically, needle lock 47 is orientated so that the longitudinal axis of needle lock 47 is co-axial with the longitudinal axis of bore 51, with first end 73 of needle lock 47 directed in towards entry end 53 of bore 51. First end 73 of needle lock 47 is then inserted into entry end 53 of bore 51. As first end 73 of needle lock 47 is inserted into entry end 53 of bore 51, tapered surface 83 of teeth 81 abut against needle carrier 43 at entry end 53. As first end 73 of needle lock 47 is advanced into bore 51 in the direction towards exit end 55, tapered surface 83 of teeth 81 continues to contact against needle carrier 43. The contact between tapered surface 83 of teeth 81 and needle carrier 43 causes fingers 79 to inwardly pivot, or compress, to such a degree that first end 73 of needle lock 47 is capable of fitting within bore 51.

Figure 14:
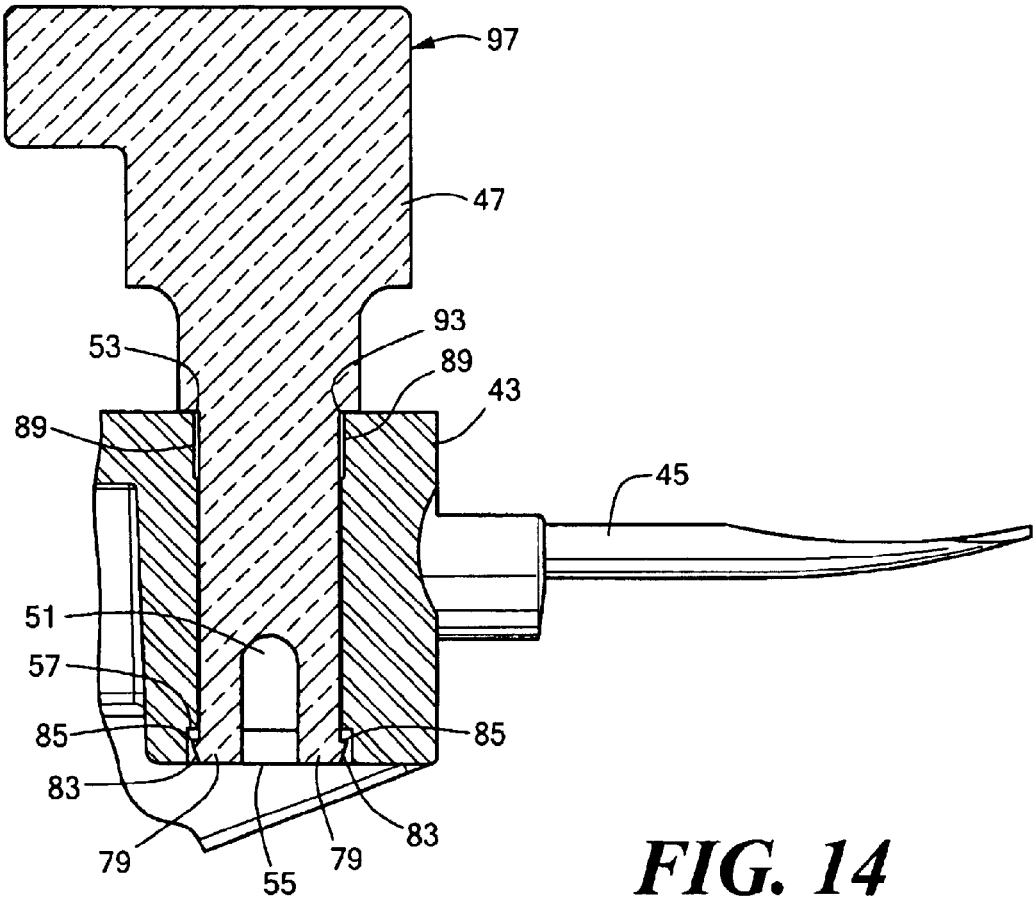
FIG. 14 is an enlarged, fragmentary, top, plan, section view of the needle assembly shown in FIG. 6, taken along lines 14—14.

First end 73 of needle lock 47 is further advanced into bore 51 in the direction towards exit end 55 until abutment surface 93 on head 91 of needle lock 47 contacts needle carrier 43 at entry end 53, thereby limiting further insertion of needle lock 47 into bore 51. As abutment surface 93 contacts needle carrier 43, first end 73 of needle lock 47 extends into the countersunk portion of needle carrier 43. As seen most clearly in FIG. 14, once tapered surface 83 of teeth 81 extends past shelf 57, needle carrier 43 no longer applies a compression force onto fingers 79. As a result, fingers 79 resiliently pivot back out to their original, parallel configuration.

With fingers 79 disposed in their original, parallel configuration, engagement surface 85 of teeth 81 are disposed to engage shelf 57 if needle lock 47 is withdrawn from bore 51. In addition, tabs 89 on needle lock 47 frictionally engage against needle carrier 43 at entry end 53. As a result, together tabs 89 and teeth 81 serve to permanently retain needle lock 47 in its mounted position within bore 51, which is a principal object of the present invention.

With needle lock 47 fixedly mounted into needle carrier 43 in the manner described above, needle lock 47 can be rotated about its longitudinal axis within bore 51 between a locked position in which needle lock 47 secures needle 45 in place within needle receiving bore 49 in needle carrier 43 and an unlocked position in which needle lock 47 allows needle 45 to freely slide in and out of needle receiving bore 49 in needle carrier 43, as will be described further in detail below.

Figure 7:
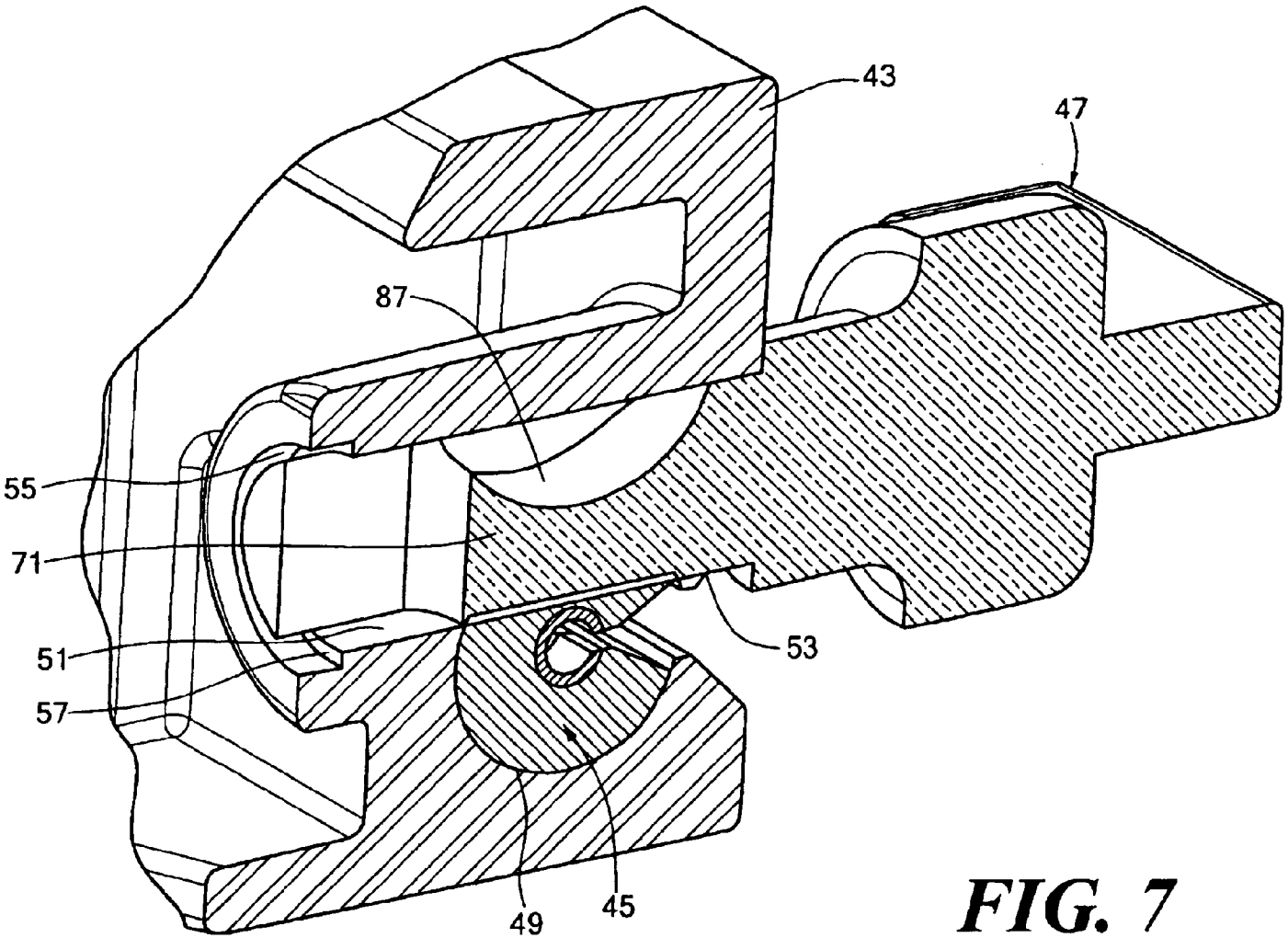
FIG. 7 is an enlarged, fragmentary, front, perspective, section view of the needle assembly shown in FIG. 6, taken along lines 7—7.
Figure 15:
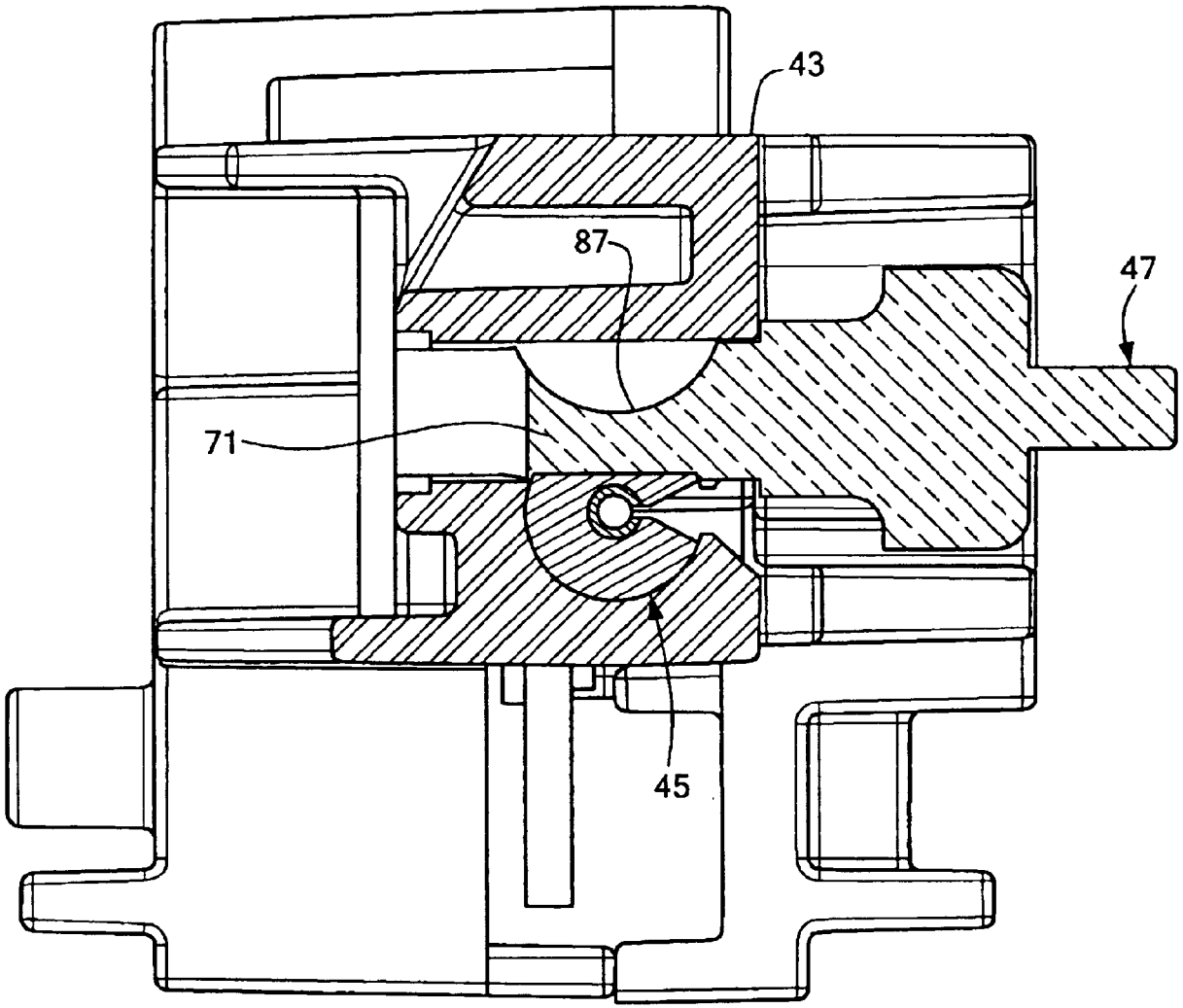
FIG. 15 is an enlarged, fragmentary, front, plan, section view of the needle assembly shown in FIG. 6, taken along lines 7—7, the needle assembly being shown with the needle lock disposed in its locked position.

In order to lock needle 45 in place within bore 49 of needle carrier 43, needle 45 must first be inserted into bore 49 of needle carrier 43. Accordingly, needle 45 is orientated so that the longitudinal axis of needle 45 is co-axial with the longitudinal axis of bore 49, with the end of needle 45 opposite sharpened tip 63 being directed in towards bore 49. Needle 45 is then inwardly advanced into bore 49, with scalloped-shaped recess 69 on base portion 61 orientated directly upward in the direction towards needle lock receiving bore 51 and with the slots of stem portion 59 and base portion 61 being orientated so as to face towards half 29 of casing 27. With needle 45 slidably disposed into bore 49 in this manner, needle lock 47 is rotated about its longitudinal axis until scalloped-shaped recess 87 is orientated directly upward (thereby disposing needle lock 47 into its locked position), as shown in FIGS. 7 and 15. With needle lock 47 now disposed in its locked position, locking post 71 extends laterally within recess 69 of needle 45. As such, the application of a withdrawal force onto needle 45 causes needle 45 to engage locking post 71 of needle lock 47, thereby effectively locking needle 45 in place within needle carrier 43.

Figure 16:
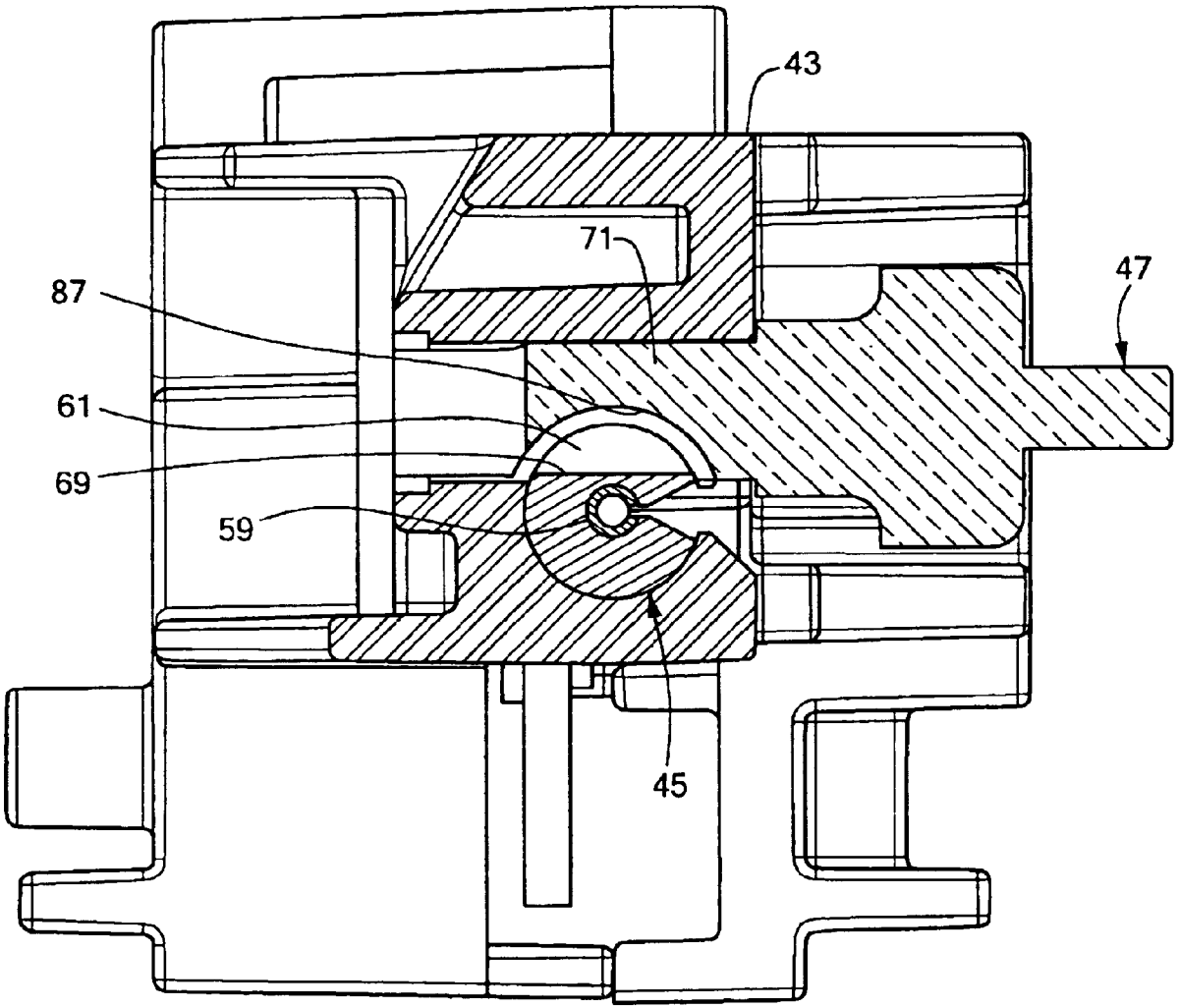
FIG. 16 is an enlarged, fragmentary, front, plan, section view of the needle assembly shown in FIG. 6, taken along lines 7—7, the needle assembly being shown with the needle lock disposed in its unlocked position.

In order to unlock needle 45 from within bore 49 of needle carrier 43, needle lock 47 is rotated about its longitudinal axis approximately 180 degrees so that scalloped-shaped recess 87 is orientated directly downward (thereby disposing needle lock 47 into its unlocked position), as shown in FIG. 16. With needle lock 47 now disposed in its unlocked position, needle 45 extends laterally within recess 87 formed in needle lock 47. Furthermore, locking post 71 is effectively rotated out from recess 69 in base portion 61 of needle 45. Because recess 87 in needle lock 47 is appropriately dimensioned to receive the entire base portion 61, needle 45 is capable of being displaced along the longitudinal axis of needle receiving bore 49. As a result, with needle lock 47 disposed in its unlocked position, needle 45 can be removed from and/or re-mounted into needle carrier 43, as desired by the operator, which is highly desirable.

Apparatus 25 additionally includes a mechanism for loading fasteners 13, one at a time, into needle 45 and for ejecting loaded fasteners 13 from needle 45. It should be noted that the particular construction of the loading/ejecting mechanism for apparatus 25 does not serve as a principal feature of the present invention and therefore, is not described in detail herein. However, it is to be understood that the loading/ejecting mechanism for apparatus 25 represents any tagger gun loading/ejecting mechanism which is well known in the art. For example, the loading/ejecting mechanism for apparatus 25 may be of the type disclosed in U.S. Pat. No. 6,267,285 to J. Raymond et al.

Figure 17:
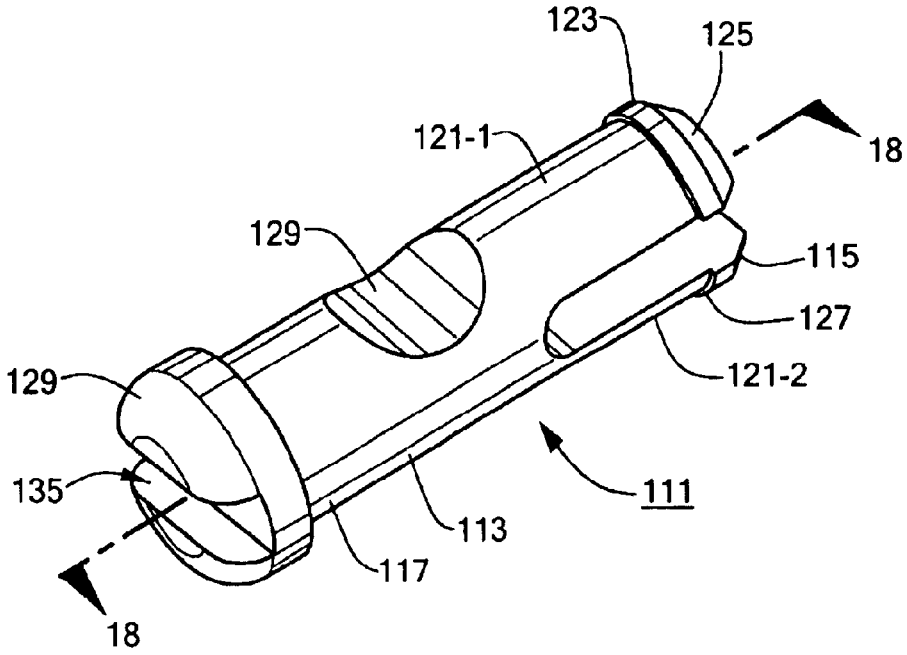
FIG. 17 is an enlarged, top, perspective view of another embodiment of a needle lock which may be used in conjunction with the apparatus shown in FIG. 2.
Figure 18:
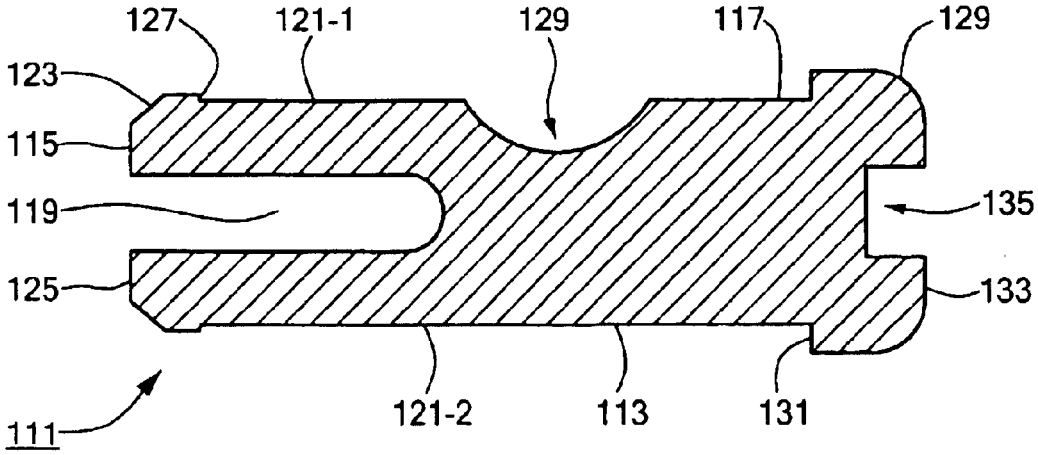
FIG. 18 is a plan, section view of the needle lock shown in FIG. 17, taken along lines 18—18.

It should be noted that numerous modifications could be made to needle lock 47 without departing from the spirit of the present invention. For example, referring now to FIGS. 17 and 18, there is shown another embodiment of a needle lock which can be used to retain needle 45 within needle carrier 43, the needle lock being identified by reference numeral 111. Needle lock 111 is of the type described in U.S. Pat. No. 6,267,285 to J. Raymond et al.

Needle lock 111 is similar to needle lock 47 in that needle lock 111 is an integral piece which is preferably constructed of molded plastic or another suitable material. Needle lock 111 comprises an elongated, generally cylindrical locking post 113 having a first end 115 and a second end 117.

First end 115 of locking post 113 is shaped to include a longitudinally-extending slot 119 which bifurcates first end 115 into first and second fingers 121-1 and 121-2. First and second fingers 121-1 and 121-2 extend longitudinally in a spaced apart, parallel relationship. Slot 119 enables fingers 121 to be inwardly pivoted upon the application of a compression force, thereby reducing the width of locking post 111 at first end 115. Upon the withdrawal of said compression force, fingers 121 resiliently outwardly pivot back to return to their original, parallel configuration.

A flange 123 is formed onto the outer periphery of locking post 113 at first end 115. Flange 123 is shaped to include a tapered surface 125 which extends outwardly and rearwardly at an acute angle from the outer surface of locking post 113 at first end 115 and an engagement surface 127 which extends outwardly at an approximate right angle from the outer surface of locking post 113.

A scallop-shaped recess 129 is formed onto the outer surface of locking post 113 between first end 115 and second end 117. Scalloped-shaped recess 129 is appropriately dimensioned to receive base portion 61 of hollow needle 45.

An enlarged, button-shaped head 129 is formed onto second end 117 of locking post 113, head 129 and locking post 113 sharing a common longitudinal axis. Head 129 is generally circular in lateral cross-section and includes a substantially flat, inner surface 131 and a substantially flat, outer surface 133. A slot 135 is formed onto outer surface 129 of head 129 to enable the user to rotate needle lock 111 using a screwdriver or other similar instrument. It should be noted that head 129 has a diameter which is greater than the diameter of locking post 113. As such, head 129 can be used as a stop for limiting the insertion of needle lock 111 into needle carrier 43.

The embodiments shown in the present invention are intended to be merely exemplary and those skilled in the art shall be able to make numerous variations and modifications to it without departing from the spirit of the present invention. All such variations and modifications are intended to be within the scope of the present invention as defined in the appended claims.

For example, it is to be understood that apparatus 25 need not be constructed in such a manner so that needle lock 47 and needle 45 are mounted onto needle carrier 43 which, in turn, is slidably disposed within tagger gun casing 27. Rather, needle lock 47 and needle 45 may alternatively be mounted directly into tagger gun casing 27 (instead of onto needle carrier 43) without departing from the spirit of the present invention.

What is claimed is:

1. An apparatus for dispensing plastic fasteners, each plastic fastener comprising a cross-bar end, said apparatus comprising:

(a) a casing;

(b) a needle assembly disposed at least partially within said casing, said needle assembly comprising, (i) a needle carrier slidably disposed at least partially within said casing, said needle carrier being shaped to include a needle receiving bore and a needle lock receiving bore, (ii) a needle removably disposed into the needle receiving bore in said needle carrier, and (iii) a needle lock for selectively locking said needle within the needle receiving bore, said needle lock being snap-mounted into the needle lock receiving bore in said needle carrier, said needle lock being adapted to engage said needle carrier upon the application of a withdrawal force on said needle lock from said needle carrier; and (c) a mechanism for pushing the cross-bar end of a plastic fastener through said needle.

2. The apparatus of claim 1 wherein said needle lock is adapted to be disposed between a locked position in which said needle lock engages said needle to preclude axial displacement of said needle within the needle receiving bore and an unlocked position in which said needle lock disengages from said needle to allow for axial displacement of said needle within the needle receiving bore.

3. The apparatus of claim 1 wherein said needle lock comprises:

(a) a locking post having a first end and a second end, the first end of said locking post being shaped to include a slot, the first end of said locking post being adapted to engage said needle carrier upon the application of a withdrawal force on said needle lock from said needle carrier; and (b) an enlarged head formed onto the second end of said locking post.

4. The apparatus of claim 3 wherein the slot bifurcates the first end of said locking post into first and second fingers which extend longitudinally in a spaced apart, parallel relationship, said fingers being adapted to inwardly pivot.

5. The apparatus of claim 3 wherein an engagement surface protrudes out from said locking post, said engagement surface being sized and shaped to selectively engage said needle carrier upon the application of a withdrawal force on said needle lock from said needle carrier.

6. The apparatus of claim 5 wherein said engagement surface extends out from said locking post at an approximate right angle in relation to the longitudinal axis of said locking post.

7. The apparatus of claim 6 wherein a tapered surface protrudes out from the first end of said locking post for guiding said needle lock into the needle lock receiving bore in said needle carrier.

8. The apparatus of claim 7 wherein the needle receiving bore extends longitudinally in from the front end of said needle carrier and the needle lock receiving bore extends laterally across the front end of said needle carrier, the needle lock receiving bore being disposed directly above and extending orthogonally in relation to the needle receiving bore.

9. The apparatus of claim 7 wherein the needle lock receiving bore includes an entry end and an exit end.

10. The apparatus of claim 9 wherein the needle carrier is countersunk at the exit end.

11. The apparatus of claim 10 wherein the needle carrier is countersunk at the exit end so as to form an annularly-shaped shelf around the needle lock receiving bore.

12. The apparatus of claim 11 wherein the engagement surface is sized and shaped to selectively engage the shelf in said needle carrier upon the application of a withdrawal force on said needle lock from said needle carrier.

13. The apparatus of claim 12 wherein a scallop-shaped recess is formed onto the outer surface of said locking post, said recess being sized and shaped to receive said needle.

14. A needle assembly for an apparatus for dispensing plastic fasteners, said needle assembly comprising:

(a) a needle carrier shaped to include a needle receiving bore and a needle lock receiving bore, (b) a needle removably disposed into the needle receiving bore in said needle carrier, and (c) a needle lock for selectively locking said needle within the needle receiving bore of said needle carrier, said needle lock being snap-mounted into the needle lock receiving bore in said needle carrier, said needle lock being adapted to engage said needle carrier upon the application of a withdrawal force on said needle lock from said needle carrier.

15. The needle assembly of claim 14 wherein said needle lock comprises:

(a) a locking post having a first end and a second end, the first end of said locking post being shaped to include a slot, the first end of said locking post being adapted to engage said needle carrier upon the application of a withdrawal force on said needle lock from said needle carrier; and (b) an enlarged head formed onto the second end of said locking post.

16. The needle assembly of claim 15 wherein the slot bifurcates the first end of said locking post into first and second fingers which extend longitudinally in a spaced apart, parallel relationship, said fingers being adapted to inwardly pivot.

17. The needle assembly of claim 15 wherein an engagement surface protrudes out from said locking post, said engagement surface being sized and shaped to selectively engage said needle carrier upon the application of a withdrawal force on said needle lock from said needle carrier.

18. The needle assembly of claim 17 wherein said engagement surface extends out from said locking post at an approximate right angle in relation to the longitudinal axis of said locking post.

19. The needle assembly of claim 18 wherein a tapered surface protrudes out from onto the first end of said locking post for guiding said needle lock into the needle lock receiving bore in said needle carrier.

20. The needle assembly of claim 19 wherein the needle receiving bore extends longitudinally in from the front end of said needle carrier and the needle lock receiving bore extends laterally across the front end of said needle carrier, the needle lock receiving bore being disposed directly above and extending orthogonally in relation to the needle receiving bore.

21. The needle assembly of claim 19 wherein the needle lock receiving bore includes an entry end and an exit end.

22. The needle assembly of claim 21 wherein the needle carrier is countersunk at the exit end so as to form an annularly-shaped shelf around the needle lock receiving bore.

23. The needle assembly of claim 22 wherein the engagement surface is sized and shaped to selectively engage the shelf in said needle carrier upon the application of a withdrawal force on said needle lock from said needle carrier.

24. A needle lock for selectively locking a needle within a needle receiving bore, said needle lock comprising:

(a) a locking post having a first end and a second end, the first end of said locking post being shaped to include a slot; and (b) an enlarged head formed onto the second end of said locking post.

25. The needle lock of claim 24 wherein said needle lock is adapted to be rotated about its longitudinal axis between a locked position in which said needle lock engages said needle to preclude axial displacement of said needle within the needle receiving bore and an unlocked position in which said needle lock disengages from said needle to allow for axial displacement of said needle within the needle receiving bore.

26. The needle lock of claim 24 wherein the slot bifurcates the first end of said locking post into first and second fingers which extend longitudinally in a spaced apart, parallel relationship, said fingers being adapted to inwardly pivot.

27. The needle lock of claim 24 wherein an engagement surface protrudes out from said locking post.

28. The needle lock of claim 27 wherein said engagement surface extends out from said locking post at an approximate right angle in relation to the longitudinal axis of said locking post.

29. The needle lock of claim 28 wherein a tapered surface protrudes out from the first end of said locking post.

30. The needle lock of claim 29 wherein a scallop-shaped recess is formed onto the outer surface of said locking post.

* * * * *